United States Patent [19]

Baumgarten

[11] Patent Number: 4,899,493

[45] Date of Patent: Feb. 13, 1990

[54] REPLACEABLE SLIDING DOOR ROLLER ASSEMBLY

[75] Inventor: James E. Baumgarten, San Pedro, Calif.

[73] Assignee: Columbia Manufacturing Corporation, Gardena, Calif.

[21] Appl. No.: 322,426

[22] Filed: Mar. 13, 1989

[51] Int. Cl.[4] ..... E05D 13/00

[52] U.S. Cl. ..... 49/425; 16/91; 16/97; 49/420; 49/421

[58] Field of Search ..... 49/425, 420, 421; 160/91; 16/91 X, 97 X, 102, 105

[56] References Cited

U.S. PATENT DOCUMENTS

| | | | |
|---|---|---|---|
| 2,664,598 | 1/1954 | Greig | 49/420 |
| 3,090,084 | 5/1963 | Banner | 49/420 |
| 3,120,033 | 2/1964 | Andres | 49/420 |
| 3,283,444 | 11/1966 | Andres | 16/105 X |
| 3,284,953 | 11/1966 | Rifkin | 49/421 X |
| 3,290,824 | 12/1966 | Anderson | 49/420 |
| 3,299,575 | 1/1967 | Du Shane | 49/420 |
| 3,386,208 | 6/1968 | Banner | 49/425 X |
| 3,716,890 | 2/1973 | Benson | 16/91 |
| 3,731,431 | 5/1973 | Banner | 49/420 |
| 3,879,893 | 4/1975 | Helmick | 49/425 X |
| 4,006,513 | 2/1977 | Offterdinger | 49/420 X |
| 4,030,160 | 6/1977 | Lambertz et al. | 16/105 |
| 4,064,593 | 12/1977 | Helnick | 16/105 |
| 4,112,622 | 9/1978 | Stewart | 49/421 |
| 4,353,186 | 10/1982 | Offterdinger | 49/425 X |
| 4,805,262 | 2/1989 | Marshik | 49/425 X |

*Primary Examiner*—Philip C. Kannan

*Attorney, Agent, or Firm*—Charles H. Thomas

[57] ABSTRACT

A roller assembly is provided as an easily replaceable assembly for use with a sliding door. The roller assembly includes a roller or wheel mounted in a roller housing and carried in a cantilevered manner at one end of a leaf spring. The opposite end of the leaf spring is permanently bent to form a hook which is engageable with a mounting tab on an upper or lower door edge through a mounting insertion gap in the door edge such that the leaf spring extends across a bearing tab. When the hook is engaged on the mounting tab the roller is carried in a roller receiving pocket in the door edge such that the leaf spring bears against a bearing tab. The leaf spring allows the roller to move into and out of a roller receiving pocket to accommodate imperfections and obstructions in a stationary track on the door frame in which the roller travels.

13 Claims, 2 Drawing Sheets

REPLACEABLE SLIDING DOOR ROLLER ASSEMBLY

BACKGROUND OF THE INVENTION

1. Field of the Invention

The present invention relates to a removable and replaceable sliding door wheel assembly for use in a sliding door or panel.

2. Description of the Prior Art

In conventional sliding door and sliding panel assemblies a flat, rectangular door is oriented in a vertical plane. The top and bottom horizontal edges of the door are constrained to move in horizontally disposed, vertically aligned parallel tracks. Wheel assemblies are provided at the top and bottom edges of the door to facilitate movement of the door, so that the door does not literally slide on the tracks, but rather is carried by the wheels which roll on the tracks. As is well known, rolling friction is substantially less than sliding friction, so that the sliding door can be opened and closed with far less effort than a door of the same weight which literally slides along the tracks.

Sliding or rolling doors of the type described are widely used in the construction of screen doors and glass doors to provide access to porches, patios and other areas. Screen doors of this type are typically constructed with aluminum frames across which a screen mesh is stretched to inhibit the movement of insects and to restrict the amount of dust and wind which can be carried through a doorway. Glass doors of this type are constructed of glass panels held within rectangular aluminum or steel frames and rendered weather tight by a rubber or plastic gasket.

Conventional sliding doors of the type described are typically provided with plastic rollers in the form of wheels mounted for rotation within roller receiving pockets at the corners of the door in the upper and lower edges 15 thereof. Such plastic rollers are economical to manufacture and do not deteriorate from the effects of moisture. However, conventional plastic rollers can frequently become damaged through impacts with obstructions in the tracks in which they travel and through the effects of time, since many plastics become relatively brittle as they age. Very often a portion of a plastic roller wheel will break off, so that the wheel no longer turns properly. When this occurs considerably greater effort is thereafter required to open and close the sliding door. The same effects occur when a wheel or roller no longer turns properly, as a result of corrosion of the axle mechanism or jamming of dirt or grit between the wheel and the wheel housing.

Once a wheel or roller becomes defective, there is a far greater likelihood of damage to the sliding door, due to the excessive force which is required to open and close the door. Also, particularly where a portion of the wheel has broken away, the door no longer travels squarely within the door opening, but rather is easily tilted or cocked within the door frame. The door can thereafter easily become jammed in the frame. Furthermore, the door is quite likely to jump the track and come out of the frame altogether.

Manufacturers of sliding doors have attempted to solve the problem of malfunctioning sliding door wheel assemblies by mounting such assemblies in such a way that the wheel or the entire wheel assembly can be replaced. However, conventional replaceable wheel assemblies which have been employed are often rather intricate and are difficult and expensive to manufacture. This expense is necessarily passed on to the consumer in the form of a higher price for the sliding door. Also, due to the intricacy and complexity of mounting conventional, replaceable sliding door wheel assemblies, the appropriate manner of replacement is not apparent to many consumers who are unfamiliar with the door roller mechanism. Furthermore, even if a user is able to ascertain the manner in which a conventional, sliding door wheel assembly should be replaced, not infrequently the actual replacement process requires special tools or tools of a particular size or configuration which the user does not readily have at hand. As a consequence, the user is quite likely to forego replacement of the wheel assembly and simply make due with a malfunctioning sliding door.

SUMMARY OF THE INVENTION

One primary object of the present invention is to provide a sliding door wheel assembly which is very economical to manufacture and which is easily replaceable. The sliding door wheel assembly of the invention is of extremely simple construction, and can therefore be manufactured at a very low cost. Furthermore, since the design of the sliding door wheel assembly is so simple, its manner of operation and proper manner of replacement can be readily ascertained with only a brief visual inspection of the device, even by persons who do not possess good mechanical analytical abilities.

Another object of the invention is to provide a replaceable sliding door wheel assembly which can be removed and replaced on a sliding door with very little difficulty. Because the sliding door wheel assembly of the invention is so simple in construction, it can be removed and replaced on a sliding door using no tools whatsoever.

A further object of the invention is to provide a readily replaceable sliding door wheel assembly which is of simple construction, but which will adequately accommodate the irregularities, minor obstructions, and imperfections in the track in which it travels. Thus, when the wheel of the sliding door wheel assembly encounters a small obstruction, such as dirt, sand or grit in the track, the wheel housing will deflect inwardly toward the body of the sliding door and ride over small obstructions of this type. However, the wheel housing is biased outwardly from the door frame under a spring force so that the wheel will maintain contact with the track, even in regions in which the track is bowed upwardly or downwardly in the plane of movement of the sliding door. Since the wheel of the wheel assembly of the invention is biased toward the track, it will remain in rolling engagement with the track and will not jump the track even where the tracks are bowed outwardly away from each other to a rather pronounced degree.

While the wheel or roller assembly of the invention is particular suitable for use with sliding screen doors, it may be utilized in numerous other sliding panel assemblies, including sliding glass doors, sliding cabinet doors, sliding shelves and in other environments in which flat panels travel on wheels or other rollers in parallel tracks along opposite edges of a sliding panel.

In one broad aspect, the present invention may be considered to be a sliding panel assembly comprising a planar panel for sliding longitudinally within a panel opening along tracks at the top and bottom of the panel opening and wherein the upper and lower portions of the panel are hollow behind upper and lower discontinuous transverse edges. The discontinuous transverse edges define therein wheel receiving pockets, mounting hook insertion gaps longitudinally separated from the wheel receiving pockets by transverse bearing tabs, and hook clearance gaps longitudinally separated from the mounting hook insertion gaps by transverse mounting tabs. A plurality of removable wheel assemblies are provided for the sliding panel assembly.

Each of the wheel assemblies has a wheel housing, a wheel rotatably mounted in the wheel housing and a longitudinally extending leaf spring coupled at one end to the wheel housing and formed with a hook at its opposite end. The hook is engageable about a mounting tab in one of the discontinuous transverse edges. When the hook is so engaged, the wheel housing is carried in a wheel receiving pocket with the leaf spring bearing against a bearing tab, such that the wheel housing is resiliently deflectable in the plane of the panel within the wheel receiving pocket in which it is carried.

In another aspect, the present invention may be considered to be an improvement in a sliding door assembly in which rollers are mounted at the top and bottom of a sliding door and ride in stationary parallel tracks in a sliding door frame. According to the improvement of the invention, the top and bottom edges of the sliding door are provided with discontinuous structure extending perpendicular to the orientation of the sliding door and defining roller receiving pockets. For each of the roller receiving pockets there is a transverse mounting tab delineating by gaps in the discontinuous structure and located in longitudinal displacement from the associated roller receiving pocket. Also, for each roller receiving pocket there is a transverse bearing tab between an associated roller receiving pocket and an associated mounting tab.

Each roller is rotatably mounted in a roller housing and each roller housing is carried at one end of a leaf spring. The other end of the leaf spring is formed with a hook adapted for releasable engagement with a selected one of the mounting tabs, such that the roller housing is carried in a wheel receiving pocket and the leaf spring passes across a bearing tab.

Preferably, the rollers are formed as wheels, and each wheel housing of each wheel assembly has an abutment ledge which projects longitudinally beyond a wheel receiving pocket when the hook on the end of the spring thereof is engaged on a mounting tab. In this way the abutment ledge of the wheel housing longitudinally overlaps a discontinuous edge of the structure of the door in which the wheel assembly is mounted. The abutment ledge thereby forms a limit stop of deflection when the hook is engaged on a mounting tab.

The leaf spring normally biases the wheel housing and wheel outwardly away from the discontinuous transverse edge of the sliding panel or door at which the wheel housing is mounted. The wheel and wheel housing are limited in their outward movement by the separation between the tracks in the door opening in which the wheels ride above and below the sliding panel. The resiliency of the leaf spring allows the wheel and wheel assembly to be deflected inwardly toward the body of the sliding panel when the wheels encounter small obstructions, such as small pebbles, sand and dirt in the track. However, the abutment ledge on the wheel housing limits the extent to which the wheel housing can move inwardly toward the body of the sliding panel so that the wheel is not pushed so far into the wheel receiving pocket that it will jump the track as the panel is moved along the track.

Preferably also, the hooks and the transverse bearing tabs of the sliding panel assembly are each provided with mutually engageable detent means. This prevents the hooks from accidentally becoming dislodged from the transverse bearing tabs as a result of opposing longitudinal forces on the transverse discontinuous edges of the sliding panel and the removable wheel assemblies mounted thereon.

The invention may be described with greater clarity and particularity with reference to the accompanying drawings.

DESCRIPTION OF THE EMBODIMENT

Figure 1:
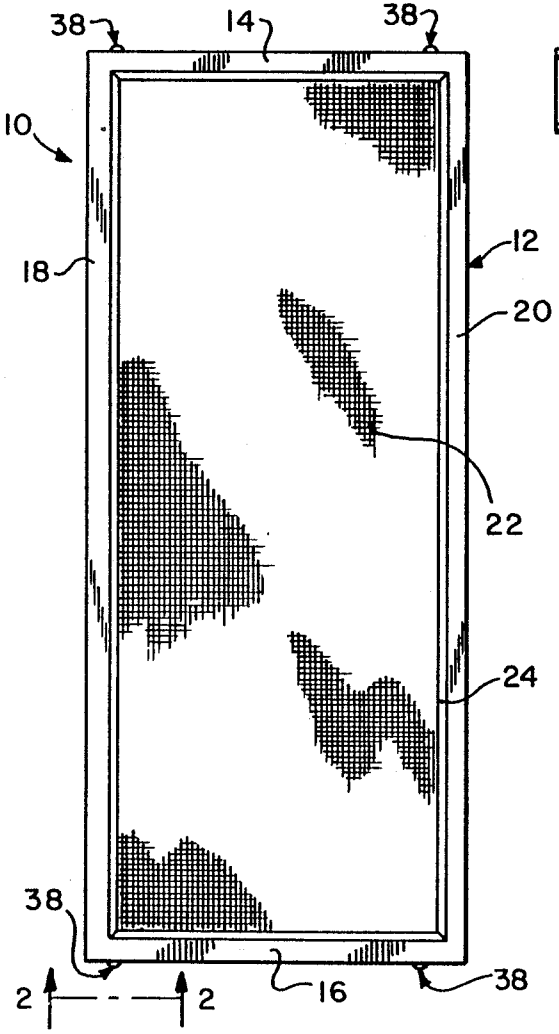
FIG. 1 is a side elevational view of an improved sliding door assembly according to the invention.

FIG. 1 illustrates a sliding door assembly 10 in which a flat, rectangular screen door 12 is provided having an outer rectangular frame formed by horizontally disposed upper and lower parallel rail portions 14 nd 16, respectively, and vertically disposed stile portions 18 and 20. Together, the rail portions 14 and 16 and the stile portions 18 and 20 form a rectangular perimeter or frame within which a rectangular section of screen mesh 22 is mounted by conventional compression beading, indicated at 24.

The door 12 is adapted to fit within a door opening and slides along upper and lower tracks 26 add 28, respectively, portions of which are visible in FIGS. 3 and 5–8 The tracks 26 and 28 laterally constrain the door 10 at its upper and lower edges 30 and 32, respectively, to hold the door assembly 10 within the door frame.

Figure 6:
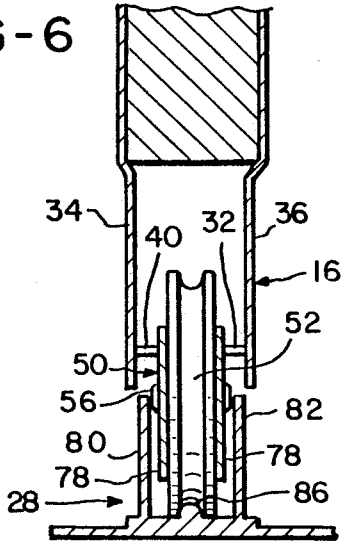
FIG. 6 is a transverse sectional elevational view taken along the lines 6—6 of FIG. 5.
Figure 8:
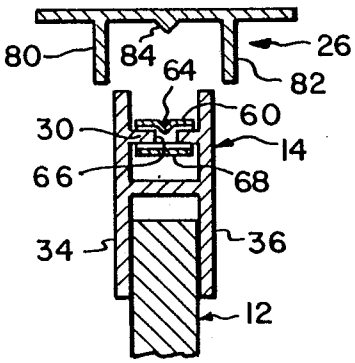
FIG. 8 is a sectional detail taken along the lines 8—8 of FIG. 7.

The upper and lower edges 30 and 32 of the door 12 respectively extend between the front surfaces 34 and the rear surfaces 36 of the rail portions 14 and 16, respectively. The edges 30 and 32 thereby span the thickness of the door 12 at its rail portions 14 and 16, which are typically on the order of between about one half and three quarters of an inch. As illustrated in FIGS. 6 and 8 the rail portions 14 and 16 are hollow above and below the edges 30 and 32. Each of the edges 30 and 32 is discontinuous at spaced locations along its length where openings in its structure define a plurality of sets of wheel receiving gaps. Each set of wheel receiving gaps is used to mount a single removable wheel assembly 38. As illustrated in FIG. 1, wheel assemblies 38 are located at both ends of the upper and lower rail portions 14 and 16, thereby providing the door assembly 10 with a total of four wheel assemblies 38, one at each corner of the screen door 12.

FIGS. 2–6 illustrate a single wheel assembly 38 in a single set of gaps in the lower edge 32 of the door 10 at the location indicated at 2—2 in FIG. 1. Within each set of gaps there are defined a wheel receiving pocket 40, a mounting insertion gap 42 and a mounting hook clearance gap 44. The mounting insertion gap 42 is separated from the wheel receiving pocket 40 by a transverse bearing tab 46, while the mounting hook clearance gap 44 is separated from the mounting insertion gap 42 by a transverse mounting tab 48. An identical set of gaps, including a wheel receiving pocket 40, a mounting insertion gap 42 and a mounting hook clearance gap 44 in the upper edge 30 of the door 12, is visible in FIG. 7. The wheel receiving gaps 40, the mounting insertion gaps 42 and the mounting hook clearance gaps 44 are thereby all formed as rectangular discontinuities or openings in the transverse edges 30 and 32. There is a removable wheel assembly 38 located at each set of gaps 40, 42 and 44. The four wheel assemblies 38 are mounted near the ends of the upper and lower rail portions 14 and 16, as illustrated in FIG. 1.

Each removable wheel assembly 38 has a wheel housing 50 which is formed as a U-shaped metal channel which may be 1.652 inches in length overall and which has vertically disposed side wall portions 78 extending outwardly from a transverse base 77. A disk-shaped plastic wheel 52 is rotatably mounted in an opening 54 in the base 77 of each wheel housing 50, and is rotatable therewithin in a vertical plane by means of an axle 56 that spans and is secured to the wheel housing side wall portions 78.

Longitudinally extending limit flanges 79 on the side wall portions 78 of the wheel housings 50 extend on either side of the wheel 52 which is mounted on the axle 56 therebetween and beyond the edges of the wheel receiving pockets 40 to form limit stops of movement of the wheel assemblies 38 into the wheel receiving pockets 40.

Each wheel assembly 38 also includes an elongated leaf spring 58, formed by a single length of spring steel slightly over three inches in length, about 0.300 inches in width, and about 0.030 inches in thickness. One end of the leaf spring 58 is permanently deformed into a hook 60 having a back or shank 68 and a return 61 having an outwardly turned tip 62, about 0.187 inches in length. The tip 62 of the return 61 is bent outwardly from the remaining structure of the hook 60 at an angle of about 15 degrees. The outwardly turned tip 62 of the return 61 facilitates capture of the mounting tab 48 by the hook 60. A dimple 64 is defined in the hook 60 and extends inwardly toward the mounting tab 48 to engage an aperture 66 therein. The dimple 64 forms a detent and the aperture 66 in the mounting tab 48 forms a detent catch for latching the hook 60 onto a mounting tab 48.

The shank 68 of the hook 60 is about 0.875 inches in length and terminates at a permanently deformed intermediate transition section 70 of the leaf spring 58. From the transition 70 the leaf spring 58 extends in an arcuate portion 72, permanently bent at a radius of 3.5 inches, but resiliently deflectable. The portion 72 is about 1.437 inches in length and terminates in a flat fastening tab 74, approximately 0.344 inches in length. The fastening tab 74 is secured to the base 77 of the channel-shaped wheel housing 50 by a rivet 76 at the end of the leaf spring 58 opposite the hook 60.

The wheel assemblies 38 are completely detachable from the upper and lower edges 30 and 32. To effectuate installation, a wheel assembly 38 is first positioned outwardly from the edge 30 or 32 in which it is to be mounted. The wheel assembly 38 is then tilted about 60 degrees from a disposition parallel to the edge 30 or 32 in which it is to be mounted in the plane of the door 12. The end of the leaf spring 58 bearing the hook 60 is then inserted into the mounting insertion gap 42 and behind the mounting tab 48.

Figure 2:
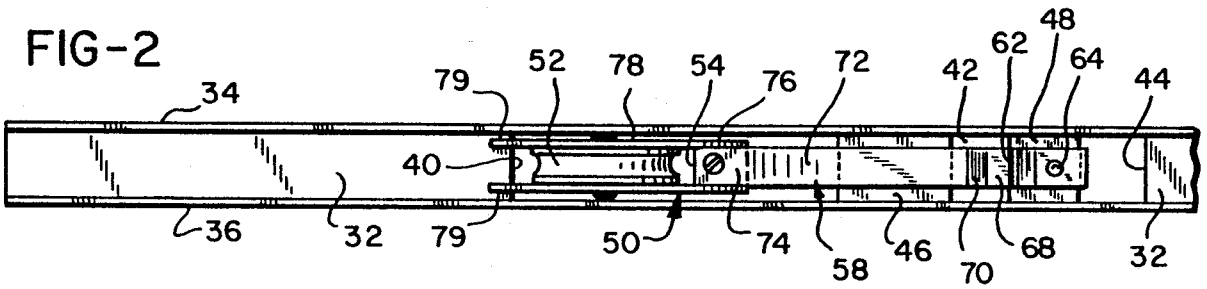
FIG. 2 is a plan detail taken along the lines 2—2 FIG. 1.
Figure 3:
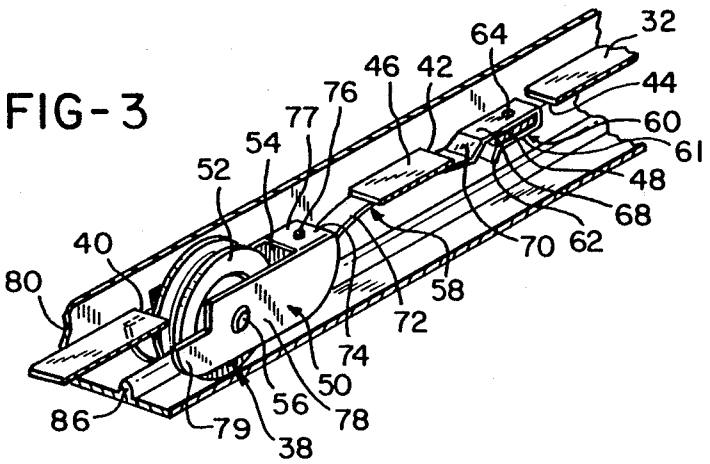
FIG. 3 is a perspective cutaway detail showing the manner of mounting of a wheel assembly in a single set of wheel receiving gaps.
Figure 4:
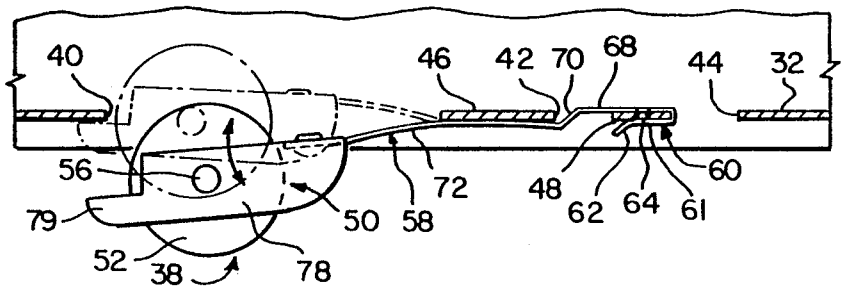
FIG. 4 a side elevational sectional detail showing the manner of mounting of the wheel assembly of FIG. 3 in one edge of the sliding door of FIG. 1.

The leaf spring 58 is then rotated toward the door edge so that the central arcuate portion 72 of the leaf spring 58 resides in contact with the outwardly facing surface of the bearing tab 46, and the wheel assembly 38 is moved longitudinally to the right, as viewed in FIG. 4, toward the mounting hook clearance gap 44 until the tip 62 of the hook 60 clears the edge of the mounting tab 48 and lies within the mounting hook clearance gap 44. The wheel assembly 38 is then pulled slightly to the left, as viewed in FIG. 4, in such a manner that the outwardly bent tip 62 of the hook 60 is wedged outwardly and passes on the outside exposed surface of the mounting tab 48. As the wheel assembly 38 is pulled to the left, as viewed in FIG. 4, the mounting tab 48 is captured between the hook return 61 and the hook shank 68.

The wheel assembly 38 is pulled along until the dimple 64 arrives in registration with the aperture 66 in the mounting tab 48. The hook return 61 then resiliently springs toward the hook shank 68 so that the dimple 64 is engaged in detent fashion in the aperture 66 as illustrated. The hook 60 is thereby firmly latched onto a mounting tab 48, and will not become accidentally dislodged therefrom due to opposing longitudinal forces on the door edge and the wheel assembly 38. Nevertheless, the hook 60 can easily be disengaged from the mounting tab 48 if desired.

With the wheel assemblies 38 installed in the manner depicted in the drawing figures, the wheels 52 will be biased outwardly to positions such as that indicated in solid lines in FIG. 4 by the leaf springs 58, since the arcuate portions 72 of the leaf springs 58 bear against the outside surface of the bearing tab 46. The bearing tabs 46 serve as fulcrums with the wheel housings 50 carried in cantilevered fashion by the leaf springs 58, the hooks 60 of which are detachably secured to the mounting tabs 48.

To install the door 12 between the upper and lower tracks 26 and 28, the door 12 is aligned in near vertical alignment and the rail portion 14 is forced upwardly between the walls 80 and 82 of the track 26. The upward force is sufficient to overcome the spring bias of the leaf springs 58 of the wheel assemblies 38 mounted on the upper door edge 30. The upward force is continued until the flanges 79 of the wheel housings 50 of the wheel assemblies 38 mounted in the upper edge 30 reside in abutment against the upper edge 15 30 at the marginal structure thereof which forms the wheel receiving pockets 40.

The limit flanges 79 of the wheel housings 50 of the wheel assemblies 38 mounted on the lower edge 32 of the door 12 are then likewise manually forced upwardly by finger pressure and brought into abutment with the structure of the lower edge 32 adjacent the locations of the wheel receiving pockets 40. The lower rail portion 16 can then be moved laterally into vertical alignment between the upper track 26 and the lower track 28. The limit flanges 79 are thereupon released.

With the release of pressure on both the upper and lower limit flanges 79, the wheels 52 of the wheel assemblies 38 will all be engaged with their respective upper and lower tracks 26 and 28, as illustrated in FIGS. 3 and 5–7. The wheels 52 are formed with radial indentations or grooves which coact with corresponding longitudinal beads 84 and 86 that are defined in the tracks 26 and 28, respectively, to maintain the wheels 52 centered within the tracks upon which they ride.

Figure 5:
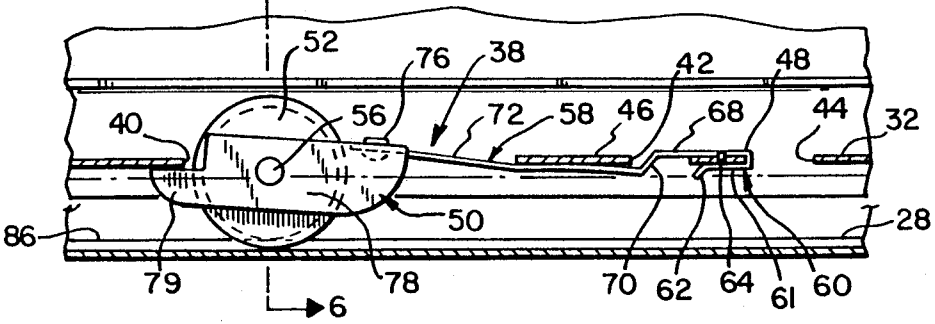
FIG. 5 illustrates the manner of movement of the wheel assembly of FIGS. 2–4 along a lower track of a door frame.
Figure 7:
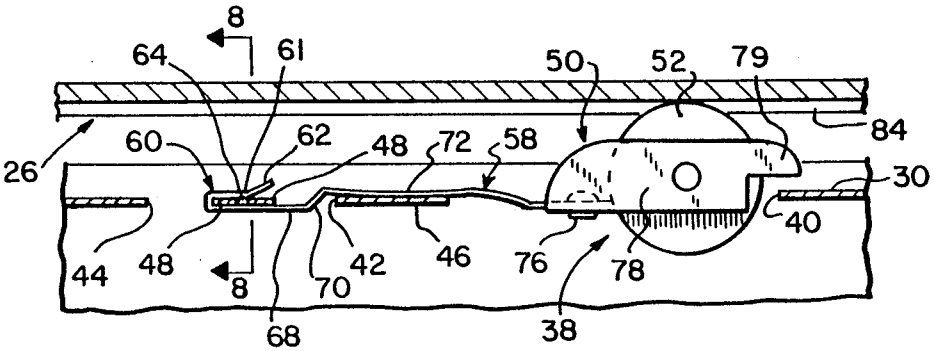
FIG. 7 is a longitudinal sectional elevational view of a wheel assembly mounted in the upper edge of the door of FIG. 1 traveling in an upper track of a door frame.

When the door 12 is installed between the tracks 26 and 28 the limit flanges 79 of the wheel assemblies 38 mounted on the lower door edge 32 will normally reside in 15 abutment against the outwardly facing surface of the lower edge 32 proximate to the wheel receiving pockets 40, since the weight of the door will normally overcome the bias of the leaf springs 58, as depicted in FIG. 5. At the top of the door 12 the wheels 52 of the upper wheel assemblies 38 will normally be biased upwardly from the upper edge 30 due to the contact between the central portions 72 of the leaf springs 58 and the bearing tabs 46, so that a gap exists between the limit flanges 79 and the upper edge 30 adjacent the wheel receiving pockets 40. The outward force exerted by the leaf springs 58 on all of the wheels 52 in all of the wheel assemblies 38 ensures that the wheels 52 will ride in contact with the tracks 26 and 28 despite any obstructions encountered in the tracks, or despite any outward bowing of the tracks 26 and 28 away from each other. Such conditions can occur due to irregularities in the underlying lintel and sill boards upon which the tracks are mounted.

As a result of the spring bias provided to the wheels 52, the wheel assemblies 38 will maintain the door 12 in smooth, rolling engagement with the tracks 26 and 28. The wheels 52 will readily deflect inwardly toward the edges 30 and 32 to pass over dirt and other small obstructions in the tracks. Nevertheless, the limit flanges 79 limit the extent of inward movement of the wheels 52 so as to prevent the rollers 52 from deflecting excessively, thereby preventing the wheels 52 from leaving the tracks.

As in other conventional door roller assemblies, it is quite possible that a wheel 52 may crack or break with prolonged use. However, unlike conventional wheel assemblies, the wheel assembly 38 of the invention may be replaced easily and without the requirement for use of any tools whatsoever.

To replace a broken wheel assembly 38, the door assembly 10 is removed from the tracks 26 and 28 by pressing upwardly on the limit flanges 79 of the wheel housings 50 of the wheel assemblies 38 mounted on the lower edge 32 until the lower wheels 52 will laterally clear the side walls 80 and 82 of the lower track 28. The door assembly 10 is then swung slightly to the side and disengaged from the tracks 26 and 28.

The outwardly extending tip 62 of the hook 60 of the roller assembly 38 to be replaced is merely lifted by means of a fingernail or thumbnail to pull the dimple 64 out of the aperture 66. The entire wheel assembly 38 is thereupon pushed longitudinally to the right, as viewed in FIG. 4, until the hook 60 will clear the mounting tab 48. The entire leaf spring 58 is thereupon rotated in a counterclockwise direction through an arc of perhaps about 60 degrees so that the hook 60 can be drawn out from behind the mounting tab 48 through the mounting insertion gap 42. The reverse procedure is utilized to install a replacement wheel assembly 38 in place of a broken assembly which has been removed. By employing the roller assemblies 38 according to the invention, the door 12 will roll smoothly within the tracks 26 and 28 indefinitely.

Undoubtedly, numerous variations and modifications of the invention will become readily apparent to those familiar with sliding door and sliding panel assemblies. For example, the roller housing does not need to be a separate part, as in the embodiment illustrated, but can be formed as an integral part of the spring itself. Accordingly, the scope of the invention should not be construed as limited to the specific embodiment described herein, but rather is defined in the claims appended hereto.

I claim:

1. A sliding panel assembly comprising a planar panel for sliding longitudinally within a panel opening along tracks at the top and bottom of said panel opening and wherein the upper and lower portions of said panel are hollow behind upper and lower discontinuous transverse edges which define therein wheel receiving pockets, mounting hook insertion gaps longitudinally separated from said wheel receiving pockets by transverse bearing tabs, and hook clearance gaps longitudinally separated from said mounting hook insertion gaps by transverse mounting tabs, a plurality of removable wheel assemblies each having a wheel housing, a wheel rotatably mounted in said wheel housing, and a longitudinally extending leaf spring coupled at one end to said wheel housing and formed with a hook at its opposite end, whereby said hook of each leaf spring is engageable about a mounting tab to carry said wheel housing in a wheel receiving pocket with said leaf spring bearing against a bearing tab, such that said wheel housing is resiliently deflectable in the plane of said panel within said wheel receiving pocket in which it is carried.

2. A sliding panel assembly according to claim 1 in which each wheel housing of each wheel assembly has an abutment ledge which projects longitudinally beyond a wheel receiving pocket when said hook thereof is engaged on a mounting tab, whereby said abutment ledge longitudinally overlaps a discontinuous edge in which said wheel assembly is mounted to form a limit stop of deflection when said hook is engaged on said mounting tab.

3. A sliding panel assembly according to claim 1 in which said mounting tabs are provided with detent catches and said hook is provided with a detent which is engageable in said detent catches.

4. A sliding panel according to claim 3 in which said detent catches are formed by apertures in said mounting tabs, and said detent is a dimple defined in said hook.

5. A sliding panel assembly according to claim 1 in which said hook includes a return, the tip of which is permanently turned outwardly away from the remainder of said leaf spring.

6. A sliding door assembly in which a flat door is adapted to fit within a door opening and slide along tracks in a door frame which laterally constrains said door at its upper and lower edges and said upper and lower edges of said door are comprised of a plurality of sets of wheel receiving gaps which define in each set of gaps a wheel receiving pocket, a mounting insertion gap separated from said wheel receiving pocket by a bearing tab, and a mounting hook clearance gap separated from said mounting insertion gap by a mounting tab, and further comprising a plurality of removable wheel assemblies each having a wheel housing, a wheel rotatably mounted in said wheel housing, and a leaf spring having a hook with a return at one end and secured to said wheel housing at its opposite end, whereby said hooks are insertable into said mounting insertion gaps to pass behind said mounting tabs, and said returns of said hook are adapted to be pulled through said hook clearance gaps to pass outside of said mounting tabs such that when said hooks engage said mounting tabs, said leaf springs bear against the outside of said bearing tabs, and said wheel housings and said wheels reside within said wheel receiving pockets.

7. A sliding door assembly according to claim 6 wherein when said hooks engage said mounting tabs, portions of said wheel housings extend beyond said wheel receiving pockets to form limit stops of movement of said wheel assemblies into said wheel receiving pockets.

8. A sliding door assembly according to claim 6 in which each return of each hook is provided with an outwardly turned tip to facilitate capture of a mounting tab by said hook.

9. A sliding door assembly according to claim 6 in which said hooks and said mounting tabs are provided with detent means for latching said hooks onto said mounting tabs.

10. A sliding door assembly according to claim 9 in which said detent means are comprised of openings through said mounting tabs and dimples in said hooks adapted to project into said openings.

11. In a sliding door assembly in which rollers are mounted at the top and bottom of a sliding door and ride in stationary parallel tracks in a sliding door frame, the improvement wherein the top and bottom edges of said sliding door are provided with discontinuous structure extending perpendicular to the orientation of said sliding door and defining roller receiving pockets, and also for each of said roller receiving pockets, a transverse mounting tab delineated by gaps in said discontinuous structure and located in longitudinal displacement from an associated roller receiving pocket, and also a transverse bearing tab between an associated roller receiving pocket and an associated mounting tab, and each roller is rotatably mounted in a roller housing and each roller housing is carried at one end of a leaf spring, the other end of which is formed with a hook adapted for releasable engagement with a selected one of said mounting tabs such that said roller housing is carried in a roller receiving pocket and said leaf spring passes across a bearing tab.

12. An improved sliding door assembly according to claim 11 in which a portion of said roller housing projects beyond said roller receiving pocket and meets said discontinuous structure when said leaf spring is deflected toward said discontinuous structure to thereby form a limit stop for limiting the extent to which said roller enters said roller receiving pocket.

13. An improved sliding door assembly according to claim 11 in which said hooks and said transverse bearing tabs are each provided with mutually engageable detent means.

* * * * *